US012565395B2

(12) United States Patent
Takato

(10) Patent No.: US 12,565,395 B2
(45) Date of Patent: Mar. 3, 2026

(54) MEDIA CONVEYING APPARATUS, MEDIA CONVEYING METHOD, AND NON-TRANSITORY RECORDING MEDIUM

(71) Applicant: PFU LIMITED, Kahoku (JP)

(72) Inventor: Yuki Takato, Kahoku (JP)

(73) Assignee: PFU LIMITED, Ishikawa (JP)

( * ) Notice: Subject to any disclaimer, the term of this patent is extended or adjusted under 35 U.S.C. 154(b) by 0 days.

(21) Appl. No.: 18/738,884

(22) Filed: Jun. 10, 2024

(65) Prior Publication Data

US 2024/0425320 A1 Dec. 26, 2024

(30) Foreign Application Priority Data

Jun. 21, 2023 (JP) ..... 2023-101916

(51) Int. Cl.

| | |
|---|---|
| ***B65H 31/10*** | (2006.01) |
| ***B65H 31/02*** | (2006.01) |
| ***B65H 31/18*** | (2006.01) |
| ***B65H 43/06*** | (2006.01) |

(52) U.S. Cl.

CPC ..... *B65H 31/10* (2013.01); *B65H 31/02* (2013.01); *B65H 31/18* (2013.01); *B65H 43/06* (2013.01); *B65H 2405/3322* (2013.01); *B65H 2557/63* (2013.01); *B65H 2601/325* (2013.01)

(58) Field of Classification Search

CPC ..... B65H 31/10; B65H 43/06; B65H 2405/3322; B65H 2601/325; B65H 31/18; B65H 2601/321; B65H 31/20

See application file for complete search history.

(56) References Cited

U.S. PATENT DOCUMENTS

| | | | | |
|---|---|---|---|---|
| 6,296,247 | B1 * | 10/2001 | Tamura | B65H 31/10 270/58.13 |
| 7,684,750 | B2 * | 3/2010 | Nagata | G03G 15/6552 399/407 |
| 8,646,903 | B2 * | 2/2014 | Murray | B41J 13/103 347/108 |
| 2015/0151941 | A1 * | 6/2015 | Kuroda | B65H 31/10 414/792.7 |

FOREIGN PATENT DOCUMENTS

| | | | |
|---|---|---|---|
| JP | 2009267589 | A | * 11/2009 |
| JP | 2017-24848 | A | 2/2017 |
| JP | 2022-41695 | A | 11/2022 |

* cited by examiner

*Primary Examiner* — Jeremy R Severson

(74) *Attorney, Agent, or Firm* — Womble Bond Dickinson (US) LLP

(57) ABSTRACT

A media conveying apparatus includes a media table on which media are to be placed, a conveyor, an ejector, an ejection table, and circuitry. The conveyor conveys the media placed on the media table. The ejector ejects the media conveyed by the conveyor. The ejection table is movable and disposed above the media table to stack the media ejected by the ejector. The circuitry controls the ejection table to be lowered based on an amount of media stacked on the ejection table while the media on the media table are sequentially conveyed. The circuitry controls the ejection table to be raised in response to completion of conveyance of all the media on the media table.

8 Claims, 11 Drawing Sheets

MEDIA CONVEYING APPARATUS, MEDIA CONVEYING METHOD, AND NON-TRANSITORY RECORDING MEDIUM

CROSS-REFERENCE TO RELATED APPLICATION

This patent application is based on and claims priority pursuant to 35 U.S.C. § 119 (a) to Japanese Patent Application No. 2023-101916, filed on Jun. 21, 2023, in the Japan Patent Office, the entire disclosure of which is hereby incorporated by reference herein.

BACKGROUND

Technical Field

Embodiments of the present disclosure relate to a media conveying apparatus, a media conveying method, and a non-transitory recording medium.

Related Art

Media conveying apparatuses such as scanners image media while conveying the media and eject the conveyed media. Such media conveying apparatuses may include an ejection table onto which media are ejected above a media table on which media are placed. In this case, the user may be hampered by the ejection table and have some difficulties in placing media on the media table.

SUMMARY

According to an embodiment of the present disclosure, a media conveying apparatus includes a media table on which media are to be placed, a conveyor, an ejector, an ejection table, and circuitry. The conveyor conveys the media placed on the media table. The ejector ejects the media conveyed by the conveyor. The ejection table is movable and disposed above the media table to stack the media ejected by the ejector. The circuitry controls the ejection table to be lowered based on an amount of media stacked on the ejection table while the media on the media table are sequentially conveyed. The circuitry controls the ejection table to be raised in response to completion of conveyance of all the media on the media table.

According to an embodiment of the present disclosure, a media conveying method includes conveying, ejecting, lowering, and raising. The conveying includes conveying media placed on a media table by a conveyor. The ejecting includes ejecting the media conveyed by the conveyor onto an ejection table by an ejector. The lowering includes lowering the ejection table based on an amount of media stacked on the ejection table while the media on the media table are sequentially conveyed. The raising includes raising the ejection table in response to completion of conveyance of all the media on the media table.

According to an embodiment of the present disclosure, a non-transitory recording medium stores a plurality of instructions which, when executed by one or more processors, causes the one or more processors to perform a method. The method includes conveying, ejecting, lowering, and raising. The conveying includes conveying media placed on a media table by a conveyor. The ejecting includes ejecting the media conveyed by the conveyor onto an ejection table by an ejector. The lowering includes lowering the ejection table based on an amount of media stacked on the ejection table while the media on the media table are sequentially conveyed. The raising includes raising the ejection table in response to completion of conveyance of all the media on the media table.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

Figure 1:
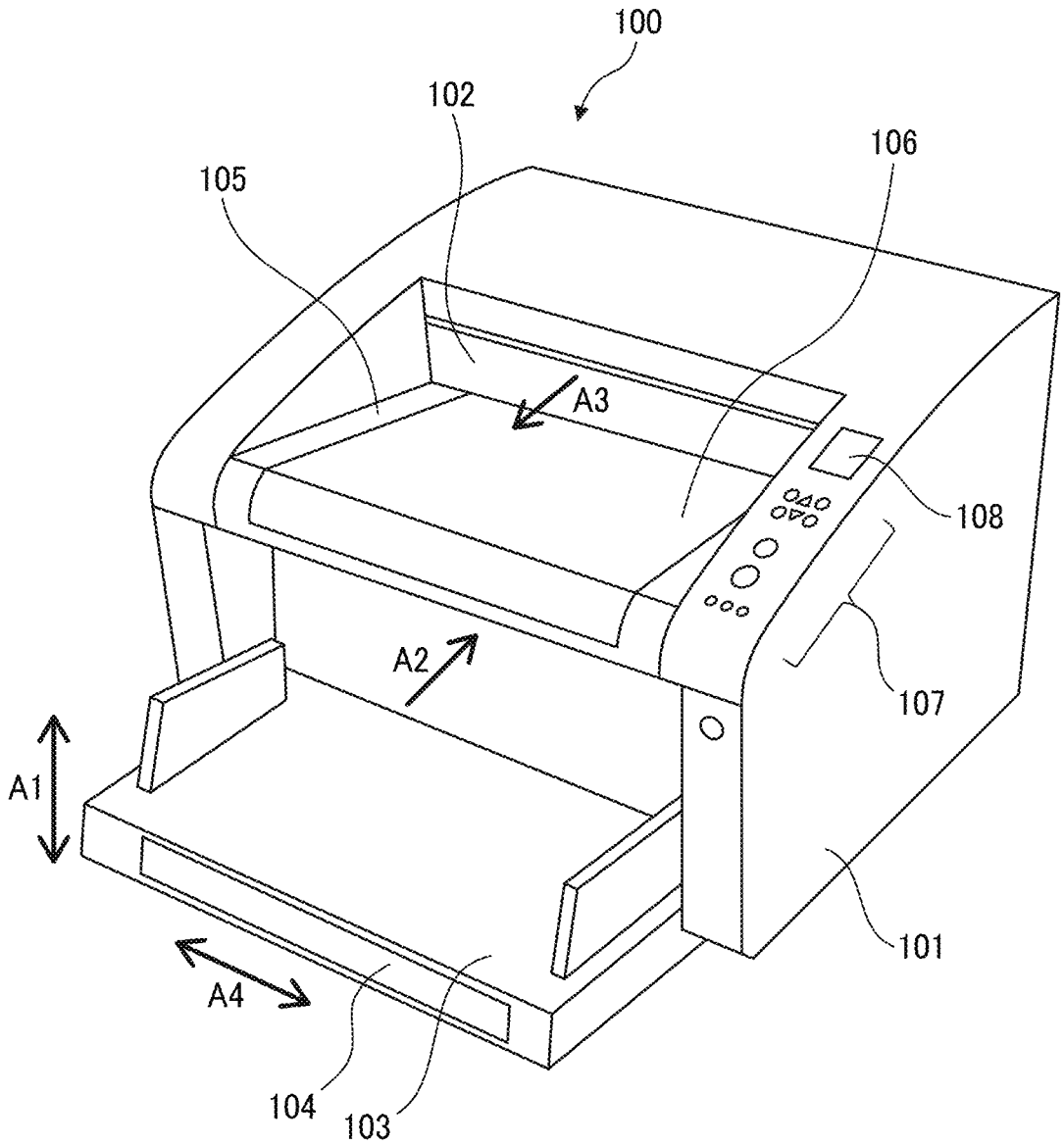
FIG. 1 is a perspective view of a media conveying apparatus according to an embodiment.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring to the drawings, embodiments of the present disclosure are described below.

As used herein, the singular forms "a," "an," and "the" are intended to include the plural forms as well, unless the context clearly indicates otherwise.

For the sake of simplicity, like reference signs denote like elements such as parts and materials having the same functions, and redundant descriptions thereof are omitted unless otherwise required.

As used herein, the term "connected/coupled" includes both direct connections and connections in which there are one or more intermediate connecting elements.

FIG. 1 is a perspective view of a media conveying apparatus 100, which is an image scanner according to an embodiment. The media conveying apparatus 100 conveys and images media being documents. The media include sheets of plain paper, sheets of thick paper, or cards. Alternatively, the media conveying apparatus 100 may be a facsimile machine, a copier, a multifunction peripheral (MFP), etc. The media to be conveyed may be printing material (e.g., paper sheets) instead of documents. In this case, the media conveying apparatus 100 may be a printer, etc.

In FIG. 1, arrow A1 indicates a substantially vertical direction (height direction). Arrow A2 indicates a media conveyance direction in which media are conveyed. Arrow A3 indicates a media ejection direction in which media are ejected. Arrow A4 indicates a width direction orthogonal to the media conveyance direction indicated by arrow A2 or the media ejection direction indicated by arrow A3. In the following description, the height direction indicated by arrow A1, the media conveyance direction indicated by arrow A2, the media ejection direction indicated by arrow A3, and the width direction indicated by arrow A4 may be referred to as a height direction A1, a media conveyance direction A2, a media ejection direction A3, and a width direction A4, respectively. In the following description, "upstream" refers to "upstream" in the media conveyance direction A2 or the media ejection direction A3, whereas "downstream" refers to "downstream" in the media conveyance direction A2 or the media ejection direction A3.

The media conveying apparatus 100 includes, for example, a first housing 101, a second housing 102, a media table 103, an ejection table 105, an operation device 107, and a display device 108.

The second housing 102 is disposed inside the first housing 101 and is rotatably engaged with the first housing 101 with a hinge such that the second housing 102 can be opened and closed to, for example, remove a jammed medium or clean the inside of the media conveying apparatus 100.

The media table 103 is engaged with the first housing 101 such that the media to be conveyed are placed on the media table 103. The media table 103 is movable in the height direction A1, that is, up and down, and disposed on a medium-supply side of the first housing 101. The medium-supply side of the first housing 101 is the side from which the media are supplied. When no media are conveyed, the media table 103 is positioned at the lower end in the movable range of the media table 103 to facilitate the placement of media on the media table 103. When media are conveyed, the media table 103 is raised to a position so that the uppermost medium of the media on the media table 103 comes into contact with a pick roller, which is described later. The media table 103 includes a pullout tray 104 and is extendable in a direction opposite to the media conveyance direction A2.

The pullout tray 104 can be pulled out from an upstream end portion of the media table 103 in the media conveyance direction A2. When small-sized media (for example, media of A5 or smaller size) are ejected, the pullout tray 104 is accommodated inside the media table 103. When large-sized media (for example, media of A5 or larger size) are ejected, the pullout tray 104 is pulled out from the media table 103 to extend the media table 103. The pullout tray 104 cooperates with the media table 103 to support the media placed thereon and conveyed thereafter.

The ejection table 105 is engaged with the second housing 102 to stack the media ejected from a common ejection port of the first housing 101 and the second housing 102. The ejection table 105 is disposed above the media table 103 to face the media table 103, that is, to overlap the media table 103 when viewed in the height direction A1. The ejection table 105 is movable in the height direction A1, that is, up and down, and disposed on a medium-ejection side of the second housing 102. The medium-ejection side of the second housing 102 is the side from which the media are ejected. When no media are conveyed, the ejection table 105 is arranged at an upper position in the movable range of the ejection table 105 to facilitate the placement of media on the media table 103 by the user. When media are conveyed, the ejection table 105 is lowered to an appropriate position to appropriately stack the ejected media. The ejection table 105 includes an extension tray 106 and is extendable in the media ejection direction A3.

The extension tray 106 is an example of an extended portion of the ejection table 105. The extension tray 106 is rotatable at a downstream end portion of the ejection table 105 in the media ejection direction A3. When small-sized media (for example, media of A5 or smaller size) are ejected, the extension tray 106 is closed to be arranged (accommodated) on the ejection table 105. When large-sized media (for example, media of A5 or larger size) are ejected, the extension tray 106 is opened to extend from the ejection table 105. The extension tray 106 cooperates with the ejection table 105 to stack the media ejected from the common ejection port of the first housing 101 and the second housing 102.

The operation device 107 includes an input device such as keys and an interface circuit that acquires signals from the input device. The operation device 107 receives an input operation performed by the user and outputs an operation signal corresponding to the input operation performed by the user. The display device 108 includes a display and an interface circuit that outputs image data to the display, to display the image data on the display. Examples of the display include, but are not limited to, a liquid crystal and an organic electro-luminescence (EL). The display device 108 may be a liquid crystal display with a touch panel function. In this case, the operation device 107 includes an interface circuit that acquires input signals from the touch panel.

Figure 2:
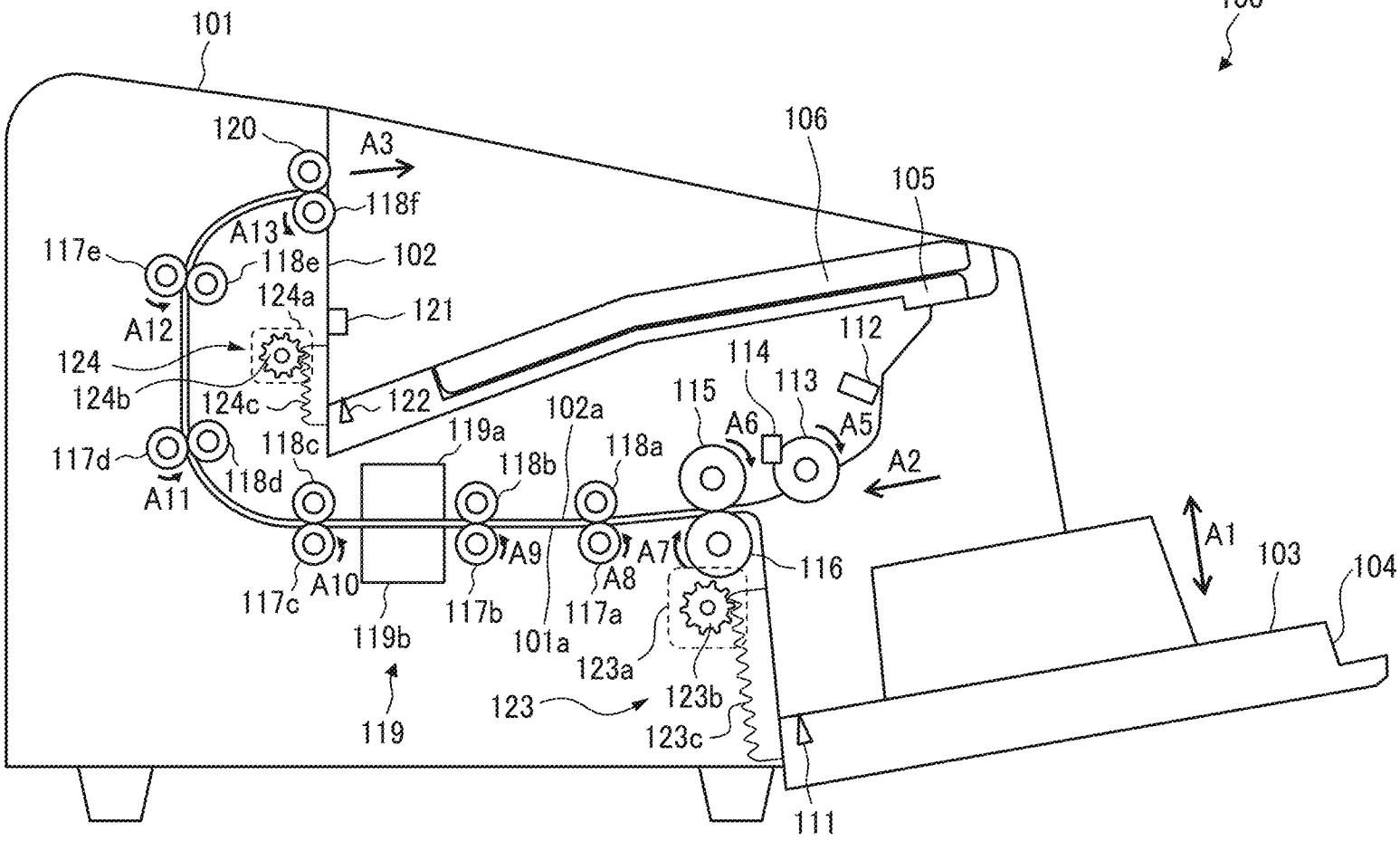
FIG. 2 is a diagram illustrating a conveyance path inside the media conveying apparatus of FIG. 1.

FIG. 2 is a diagram illustrating a conveyance path inside the media conveying apparatus 100 according to the present embodiment.

For example, the media conveying apparatus 100 includes, along the conveyance path, a first media sensor 111, a size sensor 112, a pick roller 113, a pick-roller sensor 114, a feed roller 115, a separation roller 116, first to fifth conveyance rollers 117*a* to 117*e*, first to sixth driven rollers 118*a* to 118*f*, an imaging device 119, an ejection roller 120, an ejection-table sensor 121, a second media sensor 122, a media-table moving assembly 123, and an ejection-table moving assembly 124.

The number of each of the pick roller 113, the feed roller 115, the separation roller 116, the first to fifth conveyance rollers 117*a* to 117*e*, the first to sixth driven rollers 118*a* to 118*f*, and/or the ejection roller 120 is not limited to one and may be two or more. In this case, the two or more rollers of the feed rollers 115, the separation rollers 116, the first to fifth conveyance rollers 117*a* to 117*e*, the first to sixth driven rollers 118*a* to 118*f*, and/or the ejection rollers 120 are aligned and spaced apart in the width direction A4.

The first housing 101 has a face that faces the second housing 102. The face of the first housing 101 serves as a first guide 101*a* of a media conveyance path in which media are conveyed. The second housing 102 has a face that faces the first housing 101. The face of the second housing 102 serves as a second guide 102*a* of the media conveyance path.

The first media sensor 111 is an example of a first sensor. The first media sensor 111 is disposed on the media table 103, that is, upstream from the feed roller 115 and the separation roller 116 and detects the medium on the media table 103. The first media sensor 111 determines whether a medium is present on the media table 103 with a contact sensor that causes a predetermined current to flow when a medium is in contact with the contact sensor or when no medium is in contact with the contact sensor. The first media sensor 111 generates and outputs a first media signal whose signal value changes depending on whether a medium is present on the media table 103. The first media signal is an example of an output signal from the first media sensor 111. The first media sensor 111 is not limited to the contact sensor. The first media sensor 111 may be any other sensor that can detect the presence of a medium such as an optical sensor.

The size sensor 112 is disposed above the media table 103 to detect the size of the medium on the media table 103. The size sensor 112 includes a light emitter and a light receiver. The light emitter is, for example, a light emitting diode (LED) and emits light toward a predetermined position upstream from the upstream end portion of the media table 103 in the media conveyance direction A2. The predetermined position is set to, for example, a position upstream from a downstream end portion of the media table 103 in the media conveyance direction A2 by a predetermined size. The predetermined size is set to, for example, a size obtained by adding a margin to the length of the ejection table 105 in the media ejection direction A3. The light receiver is, for example, a photodiode and receives light emitted by the light emitter and reflected from the medium on the media table 103. The time until the light receiver receives the light emitted by the light emitter changes depending on whether the medium placed on the media table 103 or the pullout tray 104 pulled out from the media table 103 is present at the position irradiated with the light from the light emitter. The light receiver generates and outputs a size signal whose signal value changes depending on whether the medium or the pullout tray 104 is present at the position irradiated with the light from the light emitter, based on the time until the light receiver receives the light emitted by the light emitter.

The pick roller 113 is disposed in the second housing 102. The pick roller 113 contacts the medium on the media table 103 that is raised to substantially the same height as the height of the media conveyance path and feeds the medium downstream in the media conveyance path. The pick roller 113 is supported by a support to be movable (swingable) in the height direction A1. The pick roller 113 is pressed downward, that is, toward the medium in contact with the pick roller 113, by a pressing member such as a spring or rubber, or the pick roller 113 pushes the media by its own weight.

The pick-roller sensor 114 is disposed near the pick roller 113 to detect whether the pick roller 113 is arranged at an initial position or at a moved position to which the pick roller 113 is pushed upward by the medium on the media table 103. The pick-roller sensor 114 includes a pair of a light emitter and a light receiver facing each other and a shield. Either one of the shield and the pair of the light emitter and the light receiver is attached to the support of the pick roller 113 to be movable together with the pick roller 113. The other one of the shield and the pair of the light emitter and the light receiver is fixed to the second housing 102. The light emitter is, for example, an LED and emits light toward the light receiver. The light receiver is, for example, a photodiode and receives light emitted by the light emitter. When the pick roller 113 is arranged at either one of the initial position and the moved position, the shield is present between the light emitter and the light receiver. When the pick roller 113 is arranged at the other one of the initial position and the moved position, the shield is absent between the light emitter and the light receiver. When the shield is present between the light emitter and the light receiver, the light emitted from the light emitter is blocked by the shield, and therefore the light receiver does not detect the light emitted from the light emitter. The light receiver generates and outputs a pick-roller signal whose signal value changes depending on whether the pick roller 113 is arranged at the initial position or the moved position, based on the intensity of the received light.

The feed roller 115 is disposed downstream from the pick roller 113 in the second housing 102 to feed the medium fed from the media table 103 by the pick roller 113 further downstream in the media conveyance path. The separation roller 116 faces the feed roller 115 in the first housing 101. The separation roller 116 is a so-called brake roller or retard roller. The separation roller 116 is stoppable or rotatable in a direction opposite to a media feeding direction in which media are fed. The feed roller 115 and the separation roller 116 perform the above-described operation to separate and feed the media one by one. The feed roller 115 is disposed above the separation roller 116. With this configuration, the media conveying apparatus 100 feeds media from the top. A separation pad may be used instead of the separation roller 116.

The first to fifth conveyance rollers 117*a* to 117*e* and the first to fifth driven rollers 118*a* to 118*e* face each other at positions downstream from the feed roller 115 and the separation roller 116 to convey the medium fed by the feed roller 115 and the separation roller 116 downstream in the media conveyance path.

The imaging device 119 is disposed downstream from the first and second conveyance rollers 117*a* and 117*b* in the media conveyance direction A2 to image the medium conveyed by the first and second conveyance rollers 117*a* and 117*b* and the first and second driven rollers 118*a* and 118*b*. The imaging device 119 includes a first imaging device 119*a* and a second imaging device 119*b* facing each other across the media conveyance path.

The first imaging device 119*a* includes, as a line sensor, a contact image sensor (CIS) employing an equal-magnification optical system and including, as imaging elements, complementary metal oxide semiconductors (CMOSs) aligned linearly in the main-scanning direction. The first imaging device 119*a* further includes a lens that forms an image on the imaging elements and an analog-to-digital (A/D) converter that amplifies the electric signals output from the imaging elements and performs analog-to-digital (A/D) conversion. The first imaging device 119*a* images the front side of the medium being conveyed, generates an input image, and outputs the input image.

Similarly, the second imaging device 119*b* includes, as a line sensor, a CIS employing the equal-magnification optical system and including, as imaging elements, CMOSs aligned linearly in the main-scanning direction. The second imaging device 119*b* further includes a lens that forms an image on the imaging elements and an A/D converter that amplifies the electric signals output from the imaging elements and performs A/D conversion. The second imaging device 119*b* images the back side of the medium being conveyed, generates an input image, and outputs the input image.

Alternatively, the media conveying apparatus 100 may include either the first imaging device 119*a* or the second imaging device 119*b* to read only one side of the medium. The line sensor may be, instead of the CIS employing the equal-magnification optical system and including CMOSs as imaging elements, a CIS employing the equal-magnification optical system and including charge-coupled devices (CCDs) as imaging elements. Alternatively, a line sensor employing a reduction optical system and including, as imaging elements, CMOSs or CCDs may be used.

The ejection roller 120 and the sixth driven roller 118*f* face each other at a position downstream from the first to fifth conveyance rollers 117*a* to 117*e*. The ejection roller 120 and the sixth driven roller 118*f* eject the medium conveyed by the first to fifth conveyance rollers 117*a* to 117*e* and the first to fifth driven rollers 118*a* to 118*e* onto the ejection table 105 and the extension tray 106.

The ejection-table sensor 121 is an example of a second sensor. The ejection-table sensor 121 is disposed on the medium-ejection side of the second housing 102 to detect the medium on the ejection table 105. The ejection-table sensor 121 is disposed at a predetermined position between the ejection port from which media are ejected and the table face of the ejection table 105 positioned at the lower end in the movable range of the ejection table 105 in the height direction A1 to detect whether the ejection table 105 or a medium is present at the predetermined position. The predetermined position is set to a position where the medium ejected from the ejection port lands on the table face of the ejection table 105 or the medium present at the predetermined position. The ejection-table sensor 121 includes a light emitter and a light receiver. The light emitter is, for example, an LED. The light emitter is proximate to a first end of the ejection table 105 in the width direction A4 to emit light toward a second end (the other end) of the ejection table 105 in the width direction A4. The light receiver is, for example, a photodiode. The light receiver is proximate to the second end of the ejection table 105 in the width direction A4 to receive light emitted by the light emitter. When the ejection table 105 or a medium on the ejection table 105 is present at the position of the ejection-table sensor 121, the light emitted from the light emitter is blocked by the ejection table 105 or the medium, and therefore the light receiver does not detect the light emitted from the light emitter. The light receiver generates and outputs an ejection-table signal whose signal value changes depending on whether the ejection table 105 or a medium on the ejection table 105 is present at the position of the ejection-table sensor 121, based on the intensity of the received light. The ejection-table signal is an example of an output signal from the ejection-table sensor 121.

The second media sensor 122 is disposed on the ejection table 105, that is, downstream from the ejection roller 120 and the sixth driven roller 118*f*, to detect a medium on the ejection table 105. The second media sensor 122 determines whether a medium is present on the ejection table 105, with a contact sensor that causes a predetermined current to flow when a medium is in contact with the contact sensor or when no medium is in contact with the contact sensor. The second media sensor 122 generates and outputs a second media signal whose signal value changes depending on whether a medium is present on the ejection table 105. The second media sensor 122 is not limited to the contact sensor. The second media sensor 122 may be any other sensor that can detect the presence of a medium such as an optical sensor.

As the pick roller 113 and the feed roller 115 rotate in media feeding directions A5 and A6, respectively, the medium on the media table 103 is conveyed in the media conveyance direction A2 between the first guide 101*a* and the second guide 102*a*. The media conveying apparatus 100 has two feeding modes: a separation mode in which media are fed while being separated and a non-separation mode in which media are fed without being separated. The feeding mode is set by the user using the operation device 107 or an information processing device communicatively connected to the media conveying apparatus 100. When the feeding mode is set to the separation mode, the separation roller 116 stops or rotates in the direction indicated by arrow A7, which is opposite to the media feeding direction. This operation prevents the feeding of a medium other than the separated medium. In short, the multiple feeding is prevented. When the feeding mode is set to the non-separation mode, the separation roller 116 rotates in the media feeding direction opposite to the direction indicated by arrow A7.

As the first and second conveyance rollers 117*a* and 117*b* rotate in the directions indicated by arrows A8 and A9, respectively, the medium is fed to the imaging position in the imaging device 119 while being guided by the first guide 101*a* and the second guide 102*a*. At the imaging portion, the imaging device 119 images the medium. As the third to fifth conveyance rollers 117*c* to 117*e* and the ejection roller 120 rotate in the directions indicated by arrows A10 to A13, respectively, the medium is ejected onto the ejection table 105 and the extension tray 106. The ejection table 105 and the extension tray 106 stack the media ejected by the ejection roller 120 and the sixth driven roller 118*f*.

The pick roller 113, the feed roller 115, the separation roller 116, the first to fifth conveyance rollers 117*a* to 117*e*, and/or the first to fifth driven rollers 118*a* to 118*e* are examples of conveyors and convey a medium placed on the media table 103. The ejection roller 120 and the sixth driven roller 118*f* are examples of ejectors and eject the medium conveyed by the conveyors.

The media-table moving assembly 123 raises and lowers the media table 103. The media-table moving assembly 123 includes, a first motor 123*a*, a first pinion 123*b*, a first rack 123*c*, etc. The first pinion 123*b* and the first rack 123*c* are disposed at one end or both ends of the media table 103 in the width direction A4. The first motor 123*a* rotates under the control of a processing circuit, which will be described later, and generates a driving force for raising and lowering the media table 103. The first pinion 123*b* is attached to the shaft of the first motor 123*a* and meshed with the first rack 123*c*. The first rack 123*c* is movable up and down along a guide such as a rail extending in the height direction A1. The media table 103 is attached to the first rack 123*c* and movable up and down in accordance with the rotation of the first pinion 123*b*. The media-table moving assembly 123 may raise and lower the media table 103 with a member such as a solenoid, a belt, and/or a cam, instead of or in addition to the motor, the pinion, and/or the rack.

The ejection-table moving assembly 124 raises and lowers the ejection table 105. The ejection-table moving assembly 124 includes, a second motor 124*a*, a second pinion 124*b*, a second rack 124*c*, etc. The second pinion 124*b* and the second rack 124*c* are disposed at one end or both ends of the ejection table 105 in the width direction A4. The second motor 124*a* rotates under the control of the processing circuit, which will be described later, and generates a driving force for raising and lowering the ejection table 105. The second pinion 124*b* is attached to the shaft of the second motor 124*a* and meshed with the second rack 124*c*. The second rack 124*c* is movable up and down along a guide such as a rail extending in the height direction A1. The ejection table 105 is attached to the second rack 124*c* and movable up and down in accordance with the rotation of the second pinion 124*b*. The ejection-table moving assembly 124 may raise and lower the ejection table 105 with a member such as a solenoid, a belt, and/or a cam, instead of or in addition to the motor, the pinion, and/or the rack.

Figure 3:
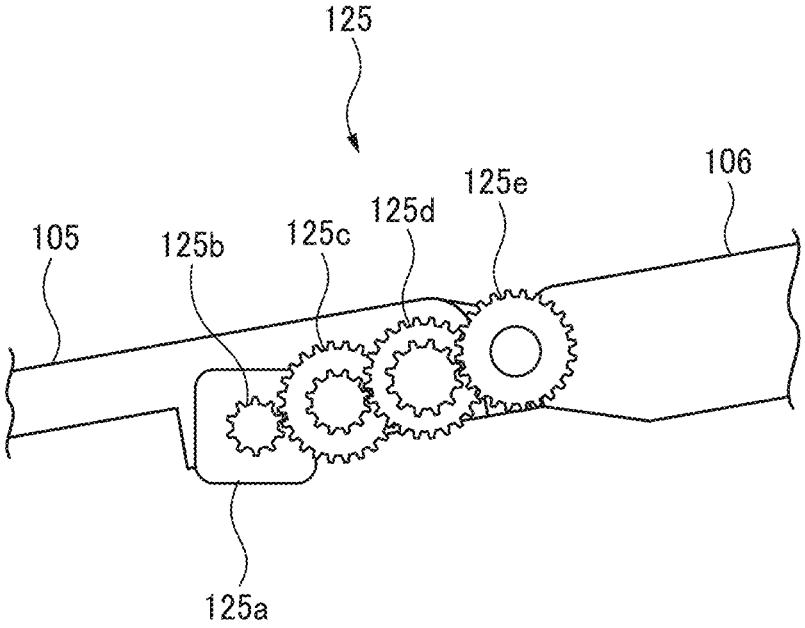
FIG. 3 is a diagram illustrating an assembly for moving an extension tray.

FIG. 3 is a diagram illustrating an assembly for moving the extension tray 106.

As illustrated in FIG. 3, the media conveying apparatus 100 further includes an extension-tray moving assembly 125. The extension-tray moving assembly 125 rotates the extension tray 106 with respect to the ejection table 105. The extension-tray moving assembly 125 includes, a third motor 125*a*, a plurality of gears 125*b* to 125*e*, etc. The gears 125*b* to 125*e* are disposed at one end or both ends of the ejection table 105 in the width direction A4. The third motor 125*a* rotates under the control of the processing circuit, which will be described later, and generates a driving force for rotating the extension tray 106. The gear 125*b* is attached to the shaft of the third motor 125*a* and engaged with the gear 125*c*. The gear 125*c* is engaged with the gear 125*d*. The gear 125*d* is engaged with the gear 125*e* that is attached to the fulcrum of the extension tray 106. The extension tray 106 is rotatable in accordance with the rotation of the gears 125*b* to 125*e*. The extension-tray moving assembly 125 may rotate the extension tray 106 with respect to the ejection table 105 with a member such as a belt and/or a cam instead of or in addition to the gears.

Figure 4:
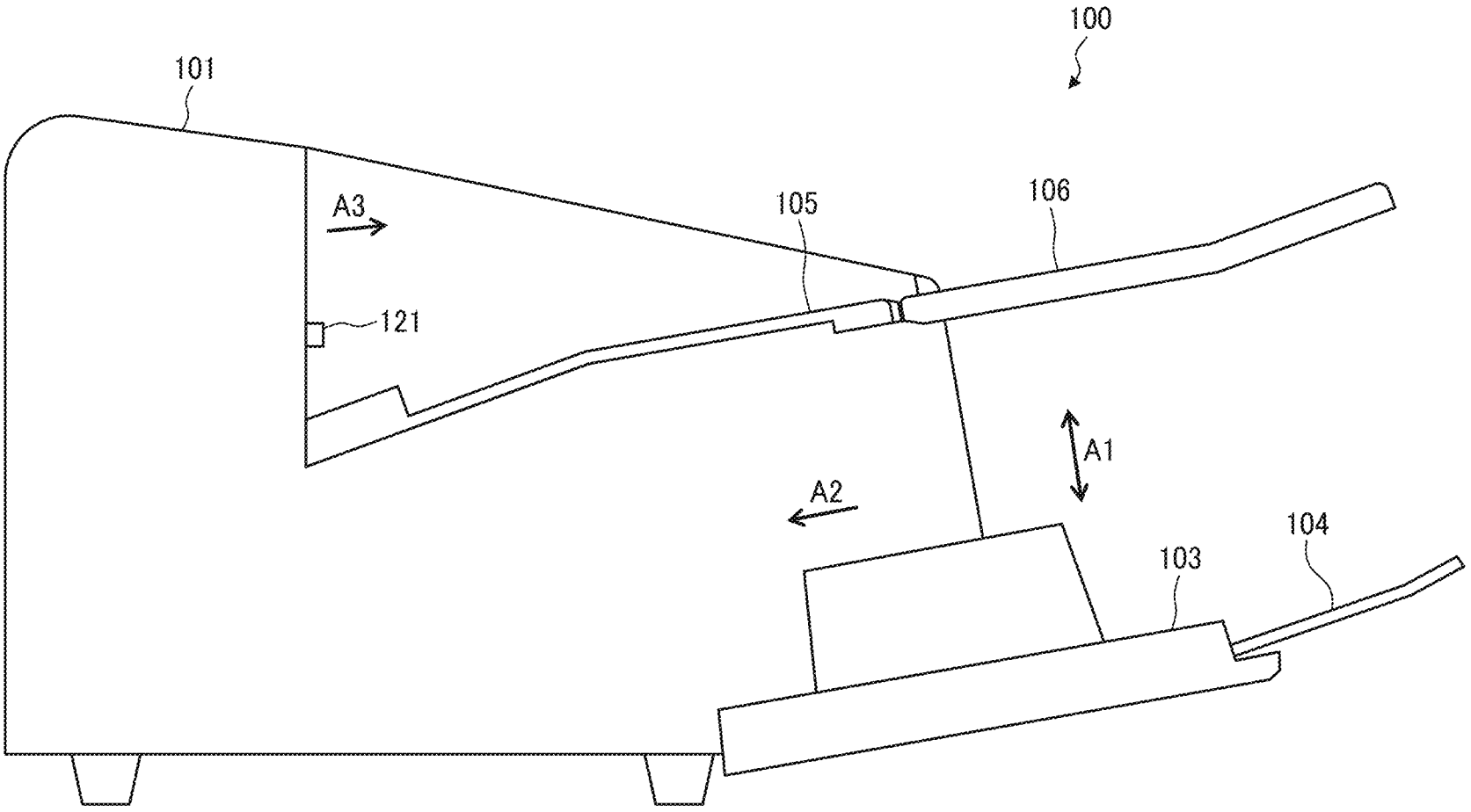
FIG. 4 is a diagram illustrating the extension tray of FIG. 3 in an open state.

FIG. 4 is a diagram illustrating the extension tray 106 in an open state.

As illustrated in FIGS. 2 and 4, the extension tray 106 is openable and closable. The extension tray 106 is accommodated on the ejection table 105 in a closed state as illustrated in FIG. 2 and extends from the ejection table 105 in an open state as illustrated in FIG. 4. With such a configuration, the extension tray 106 of the media conveying apparatus 100 can be opened and closed according to the size of the medium to be ejected. When small-sized media are ejected, the extension tray 106 is closed to reduce the entire size of the media conveying apparatus 100. Thus, the media conveying apparatus 100 can secure a workspace for the user. By contrast, when large-sized media are ejected, the extension tray 106 is opened. Thus, the media conveying apparatus 100 can stably stack the ejected media on the ejection table 105 and the extension tray 106.

Figure 5:
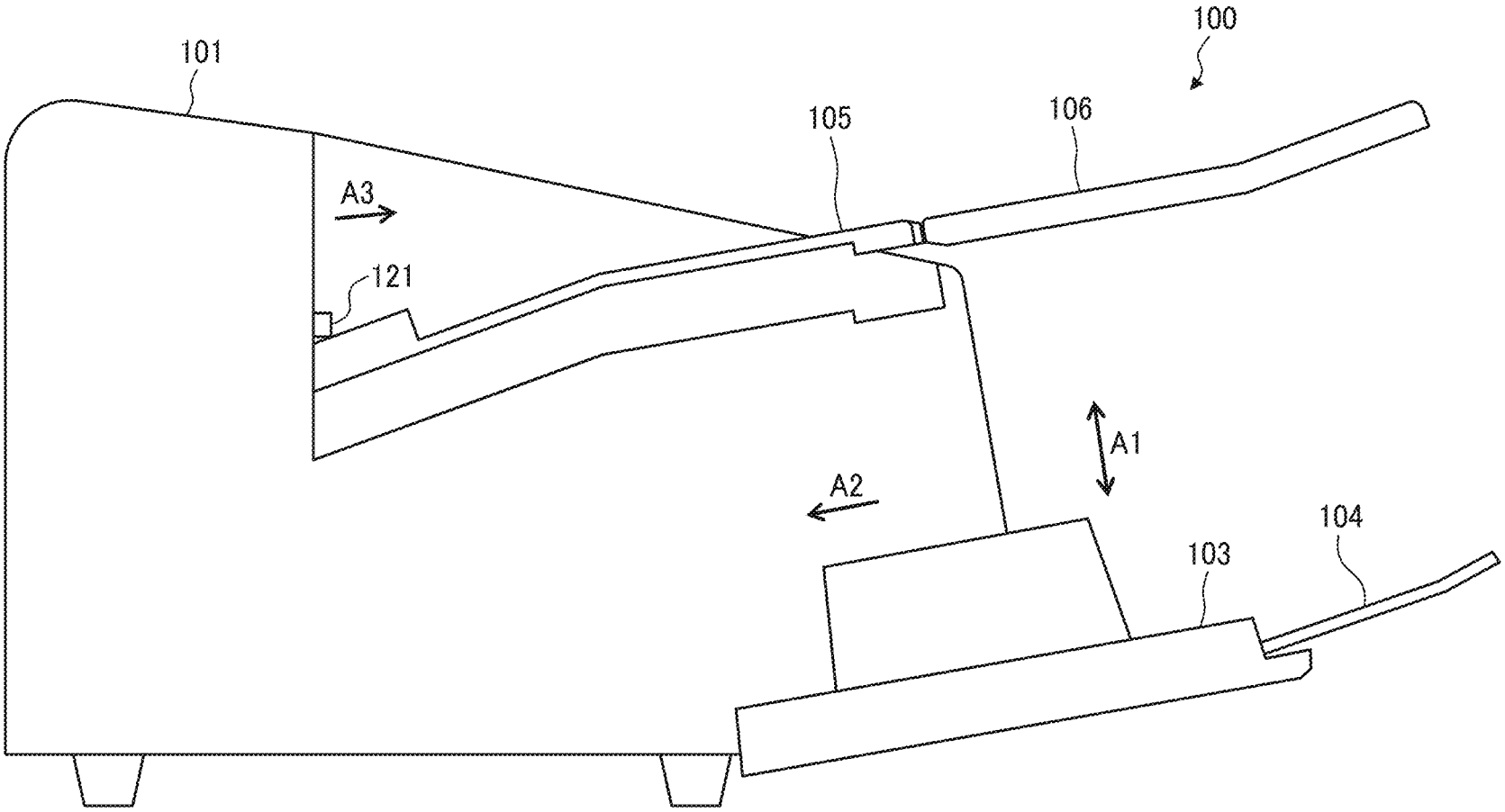
FIG. 5 is a diagram illustrating an ejection table and the extension tray of FIG. 3.

FIG. 5 is a diagram illustrating the ejection table 105 and the extension tray 106 in a raised state.

As illustrated in FIGS. 2 and 5, the ejection table 105 is movable up and down. The extension tray 106 is raised and lowered together with ejection table 105. The media conveying apparatus 100 can secure a space between the media table 103 and the ejection table 105 with the extension tray 106 by raising the ejection table 105 and the extension tray 106. Accordingly, the user can favorably place a medium on the media table 103 without being hindered by the ejection table 105 and the extension tray 106. The media conveying apparatus 100 can stack a large amount of media on the ejection table 105 and the extension tray 106 by lowering the ejection table 105 and the extension tray 106.

In the following description, the lowermost end and the uppermost end in the movable range of the table face of the ejection table 105 in the height direction A1 may be referred to as a lower limit position and the upper limit position, respectively. As illustrated in FIG. 2, the lower limit position is the position of the table face of the ejection table 105 when the ejection table 105 is arranged at the lowermost position. The upper limit position is the position of the table face of the ejection table 105 when the ejection table 105 is arranged at the uppermost position, and is, for example, the position of the ejection-table sensor 121.

Figure 6:
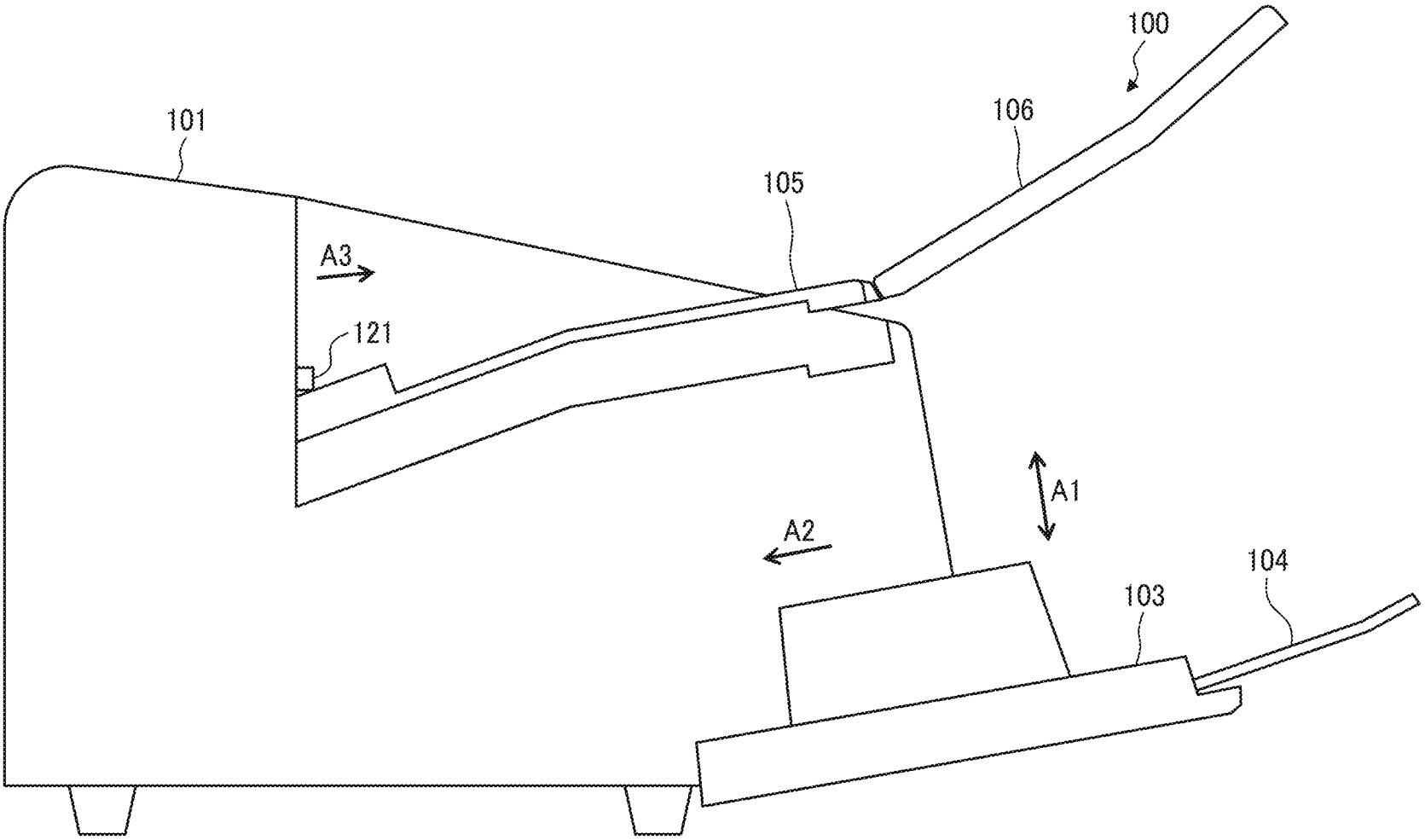
FIG. 6 is another diagram illustrating the extension tray of FIG. 3.

FIG. 6 is another diagram illustrating the extension tray 106.

As illustrated in FIG. 6, the extension tray 106 is rotatable (swingable) upward from the state illustrated in FIG. 4. As illustrated in FIG. 4, the extension tray 106 is disposed such that the table face of the extension tray 106 and the table face of the ejection table 105 are substantially parallel to each other. Thus, large-sized media can be favorably stacked on the extension tray 106 in cooperation with the ejection table 105. In addition, as illustrated in FIG. 6, the extension tray 106 is inclined such that the downstream side of the extension tray 106 in the media ejection direction A3 is positioned upward from the ejection table 105 to secure the space between the extension tray 106 and the media table 103. Accordingly, the user can favorably place a medium on the media table 103 without being hindered by the extension tray 106.

In the following description, the position of the extension tray 106 in the closed state as illustrated in FIG. 2 may be referred to as a closed position, the position of the extension tray 106 in a state where the table face of the extension tray 106 and the table face of the ejection table 105 are substantially parallel to each other as illustrated in FIG. 4 may be referred to as a first open position, and the position of the extension tray 106 that is inclined such that the downstream side of the extension tray 106 in the media ejection direction A3 is positioned upward from the ejection table 105 as illustrated in FIG. 6 may be referred to as a second open position.

Figure 7:
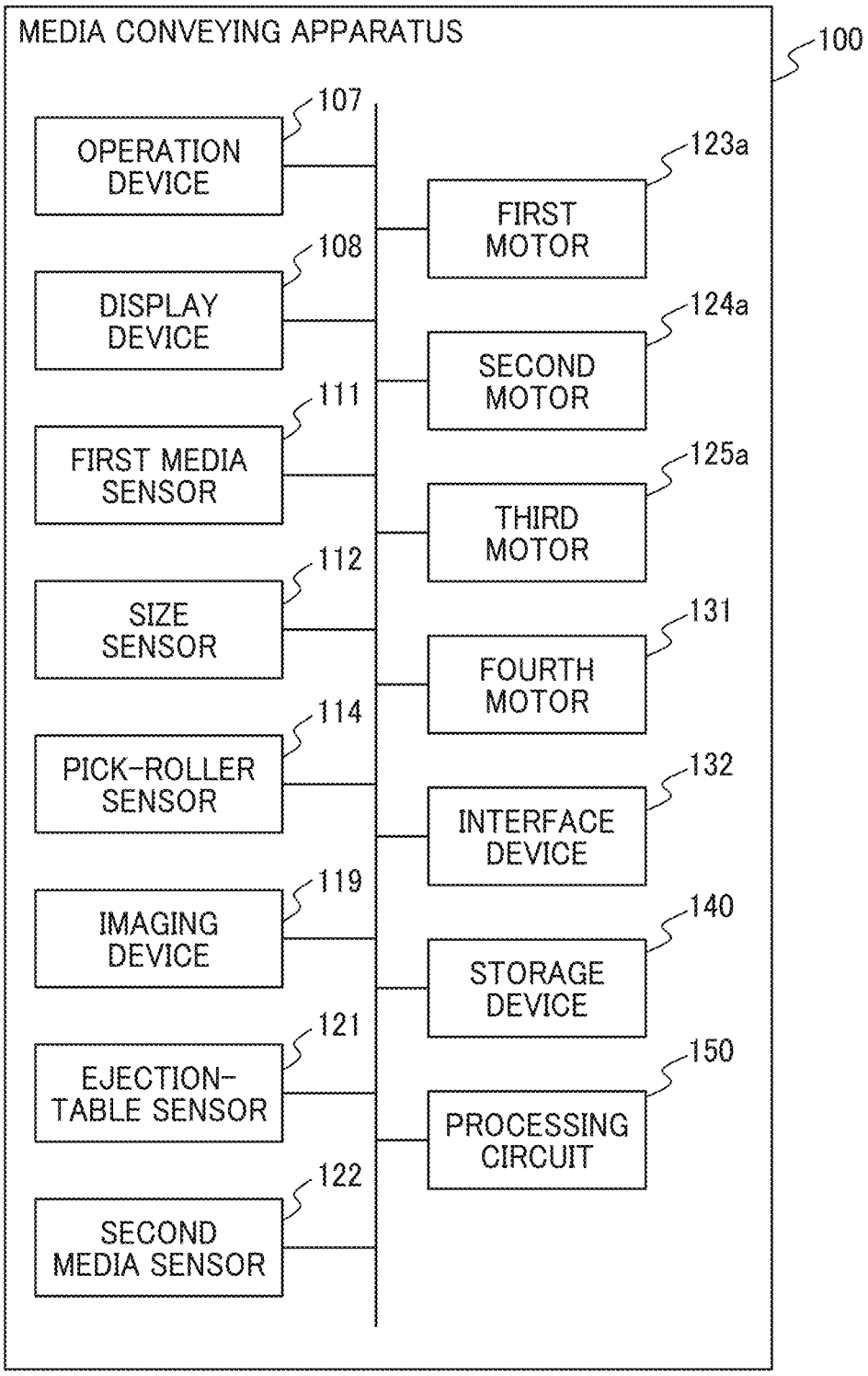
FIG. 7 is a schematic block diagram illustrating a configuration of the media conveying apparatus of FIG. 1.

FIG. 7 is a schematic block diagram illustrating a configuration of the media conveying apparatus 100 according to the present embodiment.

The media conveying apparatus 100 further includes a fourth motor 131, an interface device 132, a storage device 140, a processing circuit 150, etc., in addition to the configuration described above.

The fourth motor 131 includes one or more motors. The fourth motor 131 rotates the pick roller 113, the feed roller 115, the separation roller 116, the first to fifth conveyance rollers 117*a* to 117*e* and/or the ejection roller 120 to convey the medium and moves the media table 103 in accordance with a control signal from the processing circuit 150. The first to sixth driven rollers 118*a* to 118*f* may be rotated by the driving force from the fourth motor 131, instead of rotating in accordance with the rotation of the first to fifth conveyance rollers 117*a* to 117*e* or the ejection roller 120.

The interface device 132 includes an interface circuit compatible with a serial bus such as a universal serial bus (USB) and is electrically connected to an information processing device (for example, a personal computer or a mobile information processing terminal) to transmit and receive an input image and various kinds of information to and from the information processing device. The interface device 132 may be a communication unit including an antenna to transmit and receive wireless signals and a wireless communication interface circuit to transmit and receive the signals through a wireless communication line complying with a predetermined communication protocol. The predetermined communication protocol is, for example, a wireless local area network (LAN) communication protocol. The communication unit may include a wired communication interface circuit to transmit and receive signals through a wired communication line complying with a wired LAN communication protocol, etc.

The storage device 140 includes memories such as a random-access memory (RAM) and a read-only memory (ROM); a fixed disk device such as a hard disk; or a portable memory such as a flexible disk or an optical disk. The storage device 140 stores computer programs, databases, tables, etc. used for various processes performed by the media conveying apparatus 100. The computer programs may be installed in the storage device 140 from a computer-readable portable recording medium using, for example, a known setup program. The portable recording medium is, for example, a compact disc read-only memory (CD-ROM) or a digital versatile disc read-only memory (DVD-ROM). The computer program may be distributed from a server etc. and installed in the storage device 140.

The processing circuit 150 operates according to a program prestored in the storage device 140. The processing circuit 150 is, for example, a central processing unit (CPU). Alternatively, as the processing circuit 150, a digital signal processor (DSP), a large-scale integration (LSI), an application-specific integrated circuit (ASIC), a field-programmable gate array (FPGA), etc. may be used.

The processing circuit 150 is connected to, the operation device 107, the display device 108, the first media sensor 111, the size sensor 112, the pick-roller sensor 114, the imaging device 119, the ejection-table sensor 121, the second media sensor 122, the first motor 123*a*, the second motor 124*a*, the third motor 125*a*, the fourth motor 131, the interface device 132, the storage device 140, etc. and controls these components. The processing circuit 150 controls, for example, the driving of the motors described above and the imaging by the imaging device 119 in accordance with the signals received from the sensors described above. The processing circuit 150 acquires an input image from the imaging device 119 and transmits the input image to the information processing device via the interface device 132.

Figure 8:
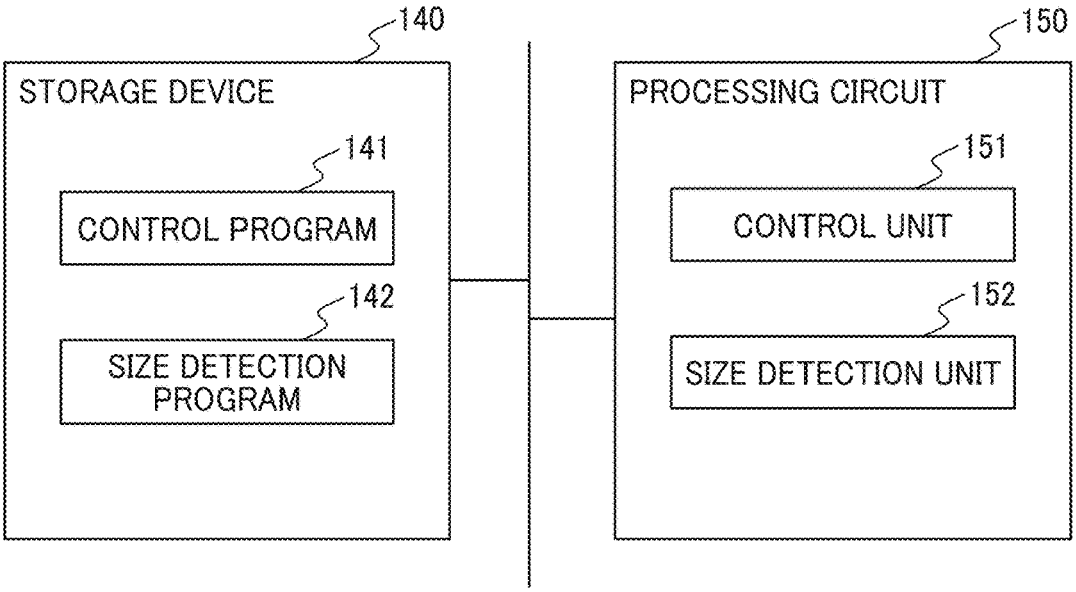
FIG. 8 is a schematic block diagram illustrating a configuration of a storage device and a processing circuit included in the media ejecting apparatus of FIG. 1.

FIG. 8 is a schematic block diagram illustrating a configuration of the storage device 140 and the processing circuit 150 according to an embodiment.

As illustrated in FIG. 8, the storage device 140 stores, a control program 141, a size detection program 142, etc. These programs are functional modules implemented by software operating on the processor. The processing circuit 150 reads the programs from the storage device 140 and operates according to the read programs. Thus, the processing circuit 150 functions as a control unit 151 and a size detection unit 152.

Figure 9:
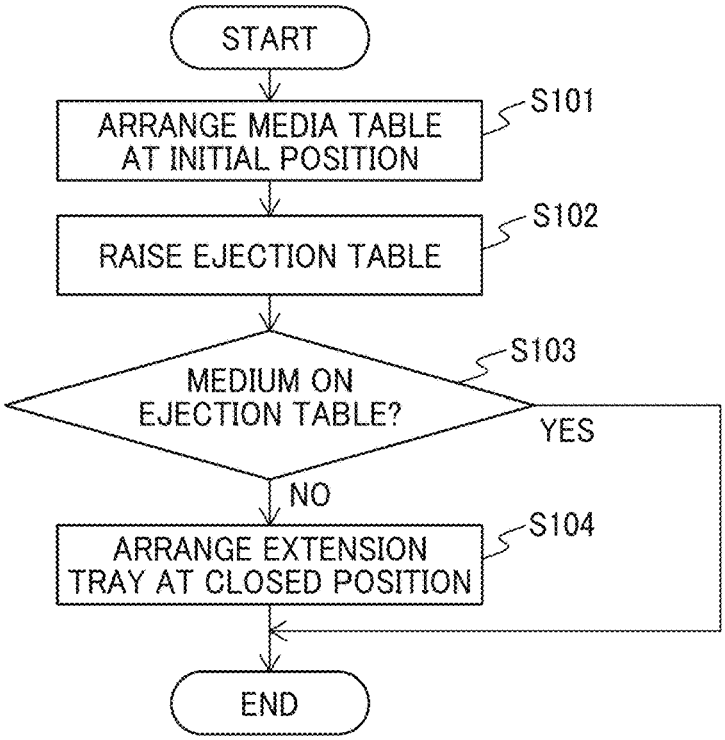
FIG. 9 is a flowchart of a startup process according to an embodiment.

FIG. 9 is a flowchart of a startup process performed by the media conveying apparatus 100 according to the present embodiment.

A description of the startup process performed by the media conveying apparatus 100 is given below with reference to the flowchart of FIG. 9. The operation process described below is executed by the processing circuit 150 etc. in cooperation with the components of the media conveying apparatus 100 based on the program prestored in the storage device 140. A monitoring process is executed immediately after the media conveying apparatus 100 is activated.

In step S101, the control unit 151 drives the first motor 123*a* and controls the media-table moving assembly 123 to lower the media table 103 to the initial position. As illustrated in FIG. 2, the initial position is the lowermost end in the movable range of the media table 103. The control unit 151 rotates the first motor 123*a* in a direction to move the media table 103 downward by a driving amount to reliably arrange the media table 103 at the initial position. Thus, the control unit 151 arranges the media table 103 at the initial position. The media table 103 at the initial position allows the user to easily place a medium on the media table 103. Thus, the media conveying apparatus 100 can enhance the convenience of the user.

The media conveying apparatus 100 may include a sensor that detects the media table 103 at the initial position. In this case, the control unit 151 may determine whether the media table 103 is arranged at the initial position with the sensor. The sensor has the same configuration as, for example, the pick-roller sensor 114. The sensor generates and outputs a signal whose signal value changes depending on whether the media table 103 is arranged at the initial position. The control unit 151 periodically acquires a signal from the sensor. When the signal value of the acquired signal indicates that the media table 103 is arranged at the initial position, the control unit 151 stops the first motor 123*a*.

In step S102, the control unit 151 drives the second motor 124*a* and controls the ejection-table moving assembly 124 to raise the ejection table 105. The control unit 151 rotates the second motor 124*a* in a direction to move the ejection table 105 upward. The control unit 151 periodically acquires the ejection-table signal from the ejection-table sensor 121. The control unit 151 stops the second motor 124*a* when the signal value of the ejection-table signal changes from a value indicating that the ejection table 105 or a medium on the ejection table 105 is absent at the position of the ejection-table sensor 121 to a value indicating that the ejection table 105 or a medium on the ejection table 105 is present at the position of the ejection-table sensor 121. Accordingly, the control unit 151 arranges the ejection table 105 so that the table face of the ejection table 105 or an uppermost medium of the media on the ejection table 105 reaches the upper limit position.

In this way, the control unit 151 raises the ejection table 105 to widen the space between the media table 103 and the ejection table 105 when the media conveying apparatus 100 is powered on. Accordingly, the media conveying apparatus 100 can secure a space between the media table 103 and the ejection table 105. The user can favorably place a medium on the media table 103 without being hindered by the ejection table 105. Thus, the media conveying apparatus 100 can enhance the convenience of the user.

In step S103, the control unit 151 acquires the second media signal from the second media sensor 122 and determines whether a medium is present on the ejection table 105 based on the acquired second media signal. When a medium is present on the ejection table 105 (YES in step S103), the control unit 151 ends the series of steps.

By contrast, when no medium is present on the ejection table 105 (NO in step S103), in step S104, the control unit 151 drives the third motor 125*a* and controls the extension-tray moving assembly 125 to arrange the extension tray 106 at the closed position. Thus, the control unit 151 ends the series of steps. The control unit 151 rotates the third motor 125*a* in a direction to close the extension tray 106 by a driving amount to reliably arrange the extension tray 106 at the closed position. Thus, the control unit 151 arranges the third motor 125*a* at the closed position.

In this way, the control unit 151 rotates the extension tray 106 to widen the space between the media table 103 and the extension tray 106 when the media conveying apparatus 100 is powered on. Accordingly, the media conveying apparatus 100 can secure the space between the media table 103 and the extension tray 106. The user can favorably place a medium on the media table 103 without being hindered by the extension tray 106. Thus, the media conveying apparatus 100 can enhance the convenience of the user.

The operation in step S101, the operation in step S102, and/or the operations in steps S103 to S104 may be omitted.

Figure 10:
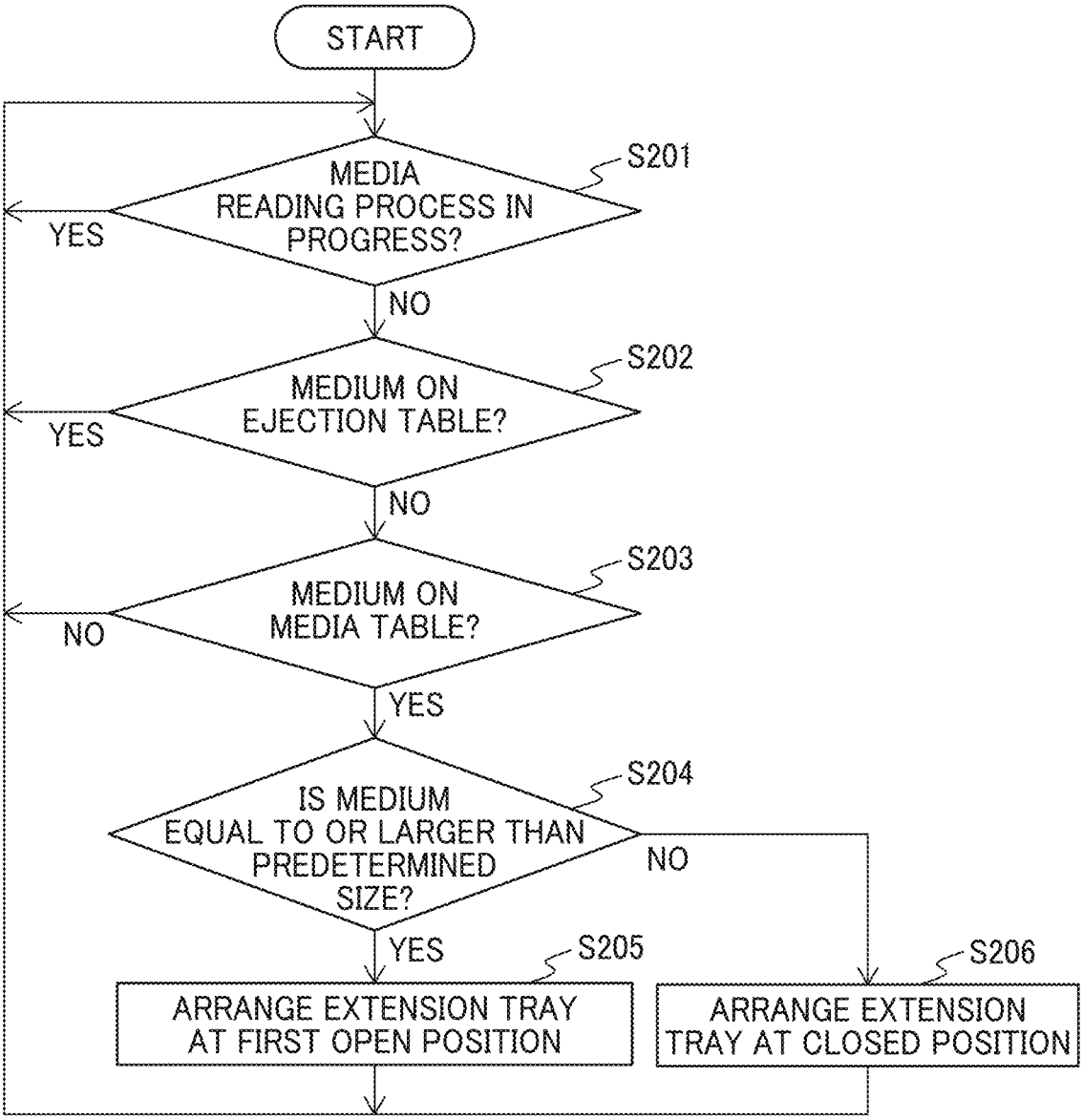
FIG. 10 is a flowchart of a monitoring process according to an embodiment.

FIG. 10 is a flowchart of a monitoring process performed by the media conveying apparatus 100 according to the present embodiment.

A description of the monitoring process performed by the media conveying apparatus 100 is given below with reference to the flowchart of FIG. 10. The operation process described below is executed, for example, by the processing circuit 150 in cooperation with the components of the media conveying apparatus 100 based on the program prestored in the storage device 140. The monitoring process is executed after the startup process is executed.

In step S201, the control unit 151 determines whether a media reading process, which will be described below, is in progress. The control unit 151 waits until the media reading process is not executed. Specifically, when the media reading process is in progress (YES in step S201), the control unit 151 repeats the determination process in step S201. By contrast, when the media reading process is not in progress (NO in step S201), the process proceeds to step S202.

In step S202, the control unit 151 acquires the second media signal from the second media sensor 122 and determines whether a medium is present on the ejection table 105 based on the acquired second media signal. When a medium is present on the ejection table 105 (YES in step S202), the control unit 151 returns to step S201 and repeats the operations from step S201 onward.

By contrast, when no medium is present on the ejection table 105 (NO in step S202), in step S203, the control unit 151 acquires the first media signal from the first media sensor 111 and determines whether a medium is present on the media table 103 based on the acquired first media signal. When no medium is present on the media table 103 (NO in step S203), the control unit 151 returns the process to step S201 and repeats the operations from step S201 onward.

By contrast, when a medium is present on the media table 103 (YES in step S203), in step S204, the size detection unit 152 determines whether the size of the medium on the media table 103 is equal to or larger than a predetermined size. The size detection unit 152 acquires the size signal from the size sensor 112. When the signal value of size signal indicates that a medium or the pullout tray 104 is present at the position irradiated with light from the light emitter, the size detection unit 152 determines that the size of the medium on the media table 103 is equal to or larger than the predetermined size. By contrast, when the signal value of the size signal indicates that a medium or the pullout tray 104 is absent at the position irradiated with light from the light emitter, the size detection unit 152 determines that the size of the medium on the media table 103 is smaller than the predetermined size. In other words, the predetermined size is a length between the downstream end of the media table 103 in the media conveyance direction A2 and the position irradiated with light from the light emitter of the size sensor 112. In this way, the size detection unit 152 detects the size of the medium on the media table 103.

When the size of the medium on the media table 103 is equal to or larger than the predetermined size (YES in step S204), in step S205, the control unit 151 drives the third motor 125*a* and controls the extension-tray moving assembly 125 to arrange the extension tray 106 at the first open position. The control unit 151 rotates the third motor 125*a* in a direction to open the extension tray 106 by a driving amount to reliably arrange the extension tray 106 at the first open position. Thus, the control unit 151 arranges the extension tray 106 at the first open position. When the extension tray 106 has been already arranged at the first open position, the control unit 151 omits the operation in step S205. The control unit 151 then returns to step S201 and repeats the operations from step S201 onward.

In this way, the control unit 151 extends the ejection table 105 according to the size of the medium on the media table 103, where the size is detected by the size detection unit 152. Accordingly, when large-sized media are conveyed, the media conveying apparatus 100 can favorably stack the ejected media on the ejection table 105 and the extension tray 106.

By contrast, when the size of the medium on the media table 103 is smaller than the predetermined size (NO in step S204), in step S206, the control unit 151 drives the third motor 125*a* and controls the extension-tray moving assembly 125 to arrange the extension tray 106 at the closed position. The control unit 151 rotates the third motor 125*a* in the direction to close the extension tray 106 by the driving amount to reliably arrange the extension tray 106 at the closed position. Thus, the control unit 151 arranges the third motor 125*a* at the closed position. When the extension tray 106 has been already arranged at the closed position, the control unit 151 omits the operation in step S206. The control unit 151 then returns to step S201 and repeats the operations from step S201 onward.

In this way, the control unit 151 accommodates the extension tray 106 according to the size of the medium on the media table 103 detected by the size detection unit 152. Accordingly, when small-sized media are conveyed, the media conveying apparatus 100 can be reduced in the entire size to secure a workspace for the user. Further, the user can see the entire media table 103 from above without being hindered by the extension tray 106. Thus, the media conveying apparatus 100 can enhance the visibility of the media table 103.

The monitoring process may be omitted.

Figure 11:
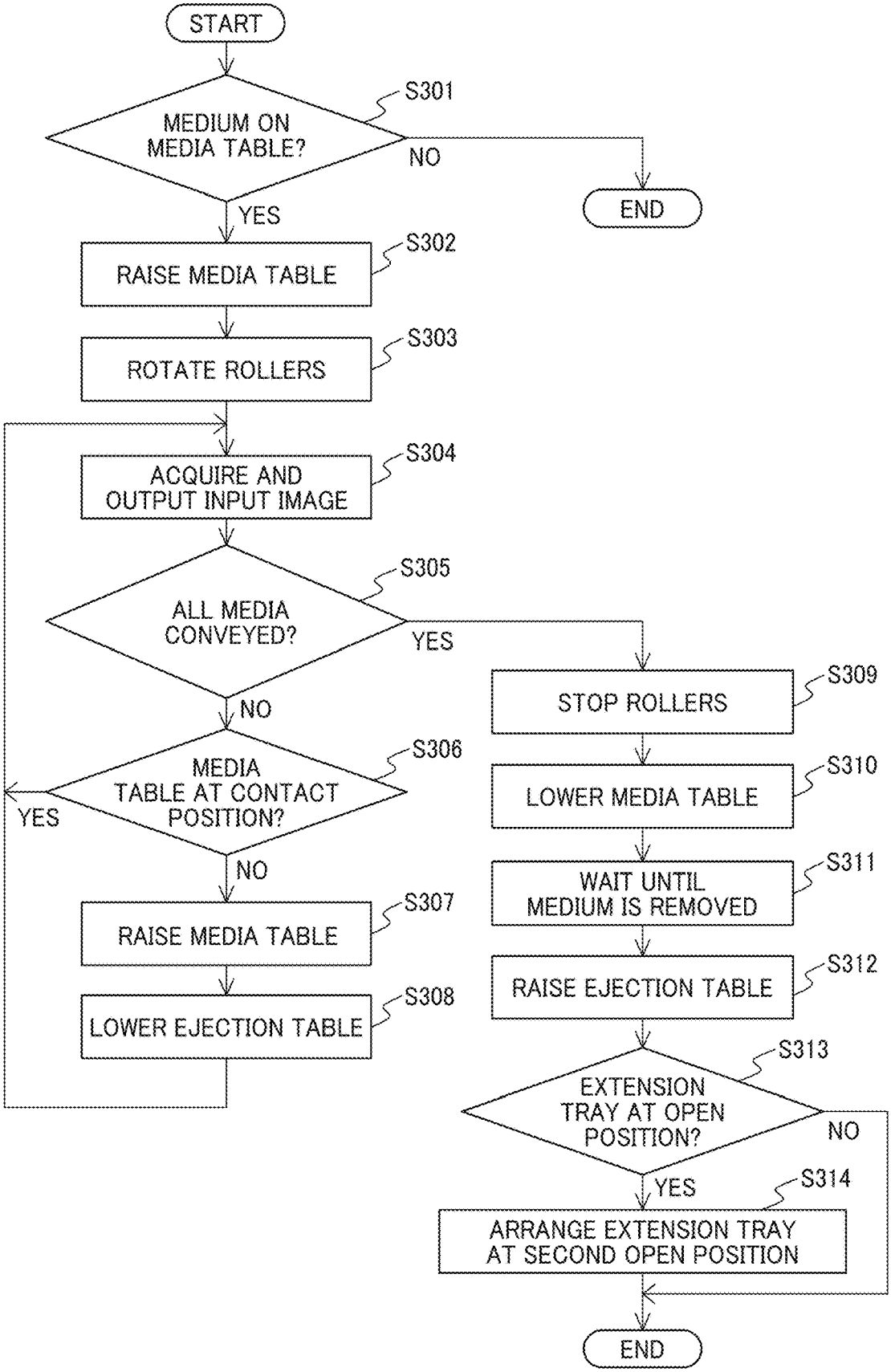
FIG. 11 is a flowchart of a media reading process according to an embodiment.

FIG. 11 is a flowchart of a media reading process performed by the media conveying apparatus 100 according to an embodiment.

A description of the media reading process performed by the media conveying apparatus 100 is given below with reference to the flowchart of FIG. 11. The operation process described below is executed, for example, by the processing circuit 150 in cooperation with the components of the media conveying apparatus 100 based on the program prestored in the storage device 140. The media reading process is executed when the control unit 151 receives an operation signal instructing the reading of media via the operation device 107 or the interface device 132. The operation signal is output when the user inputs an instruction to read media using the operation device 107 or the information processing device.

In step S301, the control unit 151 acquires the first media signal from the first media sensor 111 and determines whether a medium is present on the media table 103 based on the acquired first media signal. When no medium is present on the media table 103 (NO in step S301), the control unit 151 ends the series of steps.

By contrast, when a medium is present on the media table 103 (YES in step S301), in step S302, the control unit 151 drives the first motor 123*a* and controls the media-table moving assembly 123 to raise the media table 103. The control unit 151 rotates the first motor 123*a* in a direction to move the media table 103 upward. The control unit 151 periodically acquires the pick-roller signal from the pick-roller sensor 114. The control unit 151 stops the first motor 123*a* when the signal value of the pick-roller signal changes from a value indicating that the pick roller 113 is arranged at the initial position to a value indicating that the pick roller 113 is arranged at the moved position. Thus, the control unit 151 arranges the media table 103 at a position from which the medium can be fed.

At this time, by the operation in step S102 of FIG. 9 or the operation in step S312 described later, the ejection table 105 is arranged such that the table face of the ejection table 105 or the uppermost medium of the media on the ejection table 105 is arranged at the upper limit position.

The extension tray 106 is arranged at the first open position or the closed position when the medium is placed on the media table 103 by the operation in step S205 or S206 of FIG. 10. If the operation in step S205 or S206 of FIG. 10 is not executed after the extension tray 106 is arranged at the second open position by the operation in step 314 described later, the control unit 151 arranges the extension tray 106 at the first open position. The control unit 151 drives the third motor 125*a* and controls the extension-tray moving assembly 125 to arrange the extension tray 106 at the first open position. The control unit 151 rotates the third motor 125*a* in the direction to open the extension tray 106 by a driving amount to move the extension tray 106 from the second open position to the first open position. Thus, the control unit 151 arranges the extension tray 106 at the first open position. The media conveying apparatus 100 can favorably stack the ejected media on the ejection table 105 and the extension tray 106 by arranging the table face of the extension tray 106 substantially parallel to the table face of the ejection table 105.

In step S303, the control unit 151 drives the fourth motor 131 to rotate the pick roller 113, the feed roller 115, the separation roller 116, the first to fifth conveyance rollers 117*a* to 117*e*, the first to sixth driven rollers 118*a* to 118*f*, and/or the ejection roller 120. Thus, the control unit 151 feeds and conveys the medium.

In step S304, the control unit 151 causes the imaging device 119 to image the medium, acquires an input image from the imaging device 119, and transmits (i.e., outputs) the acquired input image to the information processing device via the interface device 132.

In step S305, the control unit 151 determines whether all the media on the media table 103 have been conveyed based on the first media signal received from the first media sensor 111. When the signal value of the first media signal indicates that a medium is present on the media table 103, the control unit 151 determines that not all the media on the media table 103 have not been conveyed yet. By contrast, when the signal value of the first media signal indicates that no medium is present on the media table 103, the control unit 151 determines that all the media on the media table 103 have been conveyed. In this way, the control unit 151 determines that all the media on the media table 103 have been conveyed based on the first media signal from the first media sensor 111. The control unit 151 can correctly determine that all the media on the media table 103 have been conveyed with the first media sensor 111.

When a medium remains on the media table 103 (NO in step S305), in step S306, the control unit 151 acquires the pick-roller signal from the pick-roller sensor 114 and determines whether the pick roller 113 is arranged at the moved position (contact position) based on the acquired pick-roller signal. When the pick roller 113 is arranged at the moved position (YES in step S306), the control unit 151 returns to step S304 and repeats the operations from step S304 onward.

By contrast, when the pick roller 113 is not arranged at the moved position (NO in step S306), in step S307, the control unit 151 drives the first motor 123*a* and controls the media-table moving assembly 123 to raise the media table 103. The control unit 151 rotates the first motor 123*a* in the direction to move the media table 103 upward. The control unit 151 periodically acquires the pick-roller signal from the pick-roller sensor 114. The control unit 151 stops the first motor 123*a* when the signal value of the pick-roller signal changes from a value indicating that the pick roller 113 is arranged at the initial position to a value indicating that the pick roller 113 is arranged at the moved position. Accordingly, the control unit 151 can appropriately feed the subsequent medium with the pick roller 113 by arranging the media table 103 to arrange the pick roller 113 at the moved position.

The control unit 151 drives the second motor 124*a* and controls the ejection-table moving assembly 124 to lower the ejection table 105 in step S308, and then returns the process to step S304. The control unit 151 rotates the second motor 124*a* in a direction to move the ejection table 105 downward by a driving amount corresponding to the distance of the upward movement of the media table 103 in step S307 or the distance obtained by adding a predetermined margin to the distance of the upward movement. Thus, the ejection table 105 is lowered by the thickness of the medium conveyed from the media table 103 to the ejection table 105 via the media conveyance path, that is, the medium newly ejected onto the ejection table 105.

In this way, the control unit 151 lowers the ejection table 105 based on the amount of the media stacked on the ejection table 105 while the media on the media table 103 are sequentially conveyed. Accordingly, the media conveying apparatus 100 can secure a space between the ejection table 105 and the ejection port and favorably stack newly ejected media on the ejection table 105.

By contrast, when no medium remains on the media table 103 (YES in step S305), in step S309, the control unit 151 controls the fourth motor 131 to stop the rollers.

In step S310, the control unit 151 drives the first motor 123*a* and controls the media-table moving assembly 123 to lower the media table 103 to the initial position. The control unit 151 arranges the media table 103 at the initial position in the same manner as the operation in step S101 of FIG. 9.

In step S311, the control unit 151 waits until the medium ejected onto the ejection table 105 is removed from the ejection table 105. The control unit 151 periodically acquires the second media signal from the second media sensor 122 and determines whether a medium is present on the ejection table 105 based on the acquired second media signal. When the control unit 151 determines that no medium is present on the ejection table 105, the control unit 151 determines that the medium ejected onto the ejection table 105 is removed from the ejection table 105.

In step S312, the control unit 151 drives the second motor 124*a* and controls the ejection-table moving assembly 124 to raise the ejection table 105. The control unit 151 rotates the second motor 124*a* in the direction to move the ejection table 105 upward. The control unit 151 periodically acquires the ejection-table signal from the ejection-table sensor 121. The control unit 151 stops the second motor 124*a* when the signal value of the ejection-table signal changes from a value indicating that the ejection table 105 or a medium on the ejection table 105 is absent at the position of the ejection-table sensor 121 to a value indicating that the ejection table 105 or a medium on the ejection table 105 is present at the position of the ejection-table sensor 121.

In this way, the control unit 151 raises the ejection table 105 to widen the space between the media table 103 and the ejection table 105 when all the media on the media table 103 have been conveyed. Accordingly, the media conveying apparatus 100 can secure the space between the media table 103 and the ejection table 105. The user can place a medium to be conveyed next on the media table 103 without being hindered by the ejection table 105. Thus, the media conveying apparatus 100 can enhance the convenience of the user.

The control unit 151 raises the ejection table 105 until the table face of the ejection table 105 or the uppermost medium of the media on the ejection table 105 reaches a predetermined height based on the output signal from the ejection-table sensor 121. The predetermined height is the position of the ejection-table sensor 121 in the height direction A1.

In step S313, the control unit 151 determines whether the extension tray 106 is arranged at the first open position. The control unit 151 determines whether the extension tray 106 is arranged at the first open position based on whether the extension tray 106 is arranged at the first open position in step S205 or step S302 of FIG. 10.

When the control unit 151 determines that the extension tray 106 is not arranged at the first open position (NO in step S313), the control unit 151 ends the series of steps.

By contrast, when the control unit 151 determines that the extension tray 106 is arranged at the first open position (YES in step S313), the control unit 151 drives the third motor 125*a* and controls the extension-tray moving assembly 125 to arrange the extension tray 106 at the second open position in step S314, and then ends the series of steps. The control unit 151 rotates the third motor 125*a* in the direction to close the extension tray 106 by a driving amount to move the extension tray 106 from the first open position to the second open position. Thus, the control unit 151 arranges the extension tray 106 at the second open position. With the extension tray 106 inclined such that the downstream side of the extension tray 106 in the media ejection direction A3 is positioned upward from the ejection table 105, the media conveying apparatus 100 can secure the space between the extension tray 106 and the media table 103. Accordingly, the user can place a medium to be conveyed next on the media table 103 without being hindered by the extension tray 106. Thus, the media conveying apparatus 100 can enhance the convenience of the user.

The operation in step S311 may be omitted. In this case, the control unit 151 may raise the ejection table 105 in step S312 and/or rotate the extension tray 106 in step S314, without waiting until the medium ejected onto the ejection table 105 is removed from the ejection table 105. When the operation in step S311 is omitted, the operation in step S312 and/or the operations in steps S313 to S314 may also be omitted.

When the operation in step S312 is omitted, the control unit 151 may raise the ejection table 105 in the monitoring process of FIG. 10. In this case, when the control unit 151 determines that the media reading process is not in progress in step S201, the control unit 151 determines whether the ejection table 105 or a medium is present at the upper limit position. The control unit 151 periodically acquires the ejection-table signal from the ejection-table sensor 121. The control unit 151 determines whether the ejection table 105 or a medium is present at the upper limit position based on whether the signal value of the ejection-table signal indicates that the ejection table 105 or a medium on the ejection table 105 is present at the position of the ejection-table sensor 121. When the ejection table 105 or a medium is absent at the upper limit position, the control unit 151 drives the second motor 124*a* and controls the ejection-table moving assembly 124 to raise the ejection table 105. The control unit 151 arranges the ejection table 105 to position the table face of the ejection table 105 or the uppermost medium of the media on the ejection table 105 at the upper limit position, in the same manner as the operation in step S312.

In this case, the control unit 151 raises the ejection table 105 to widen the space between the media table 103 and the ejection table 105 based on a determination that all the media on the media table 103 have been conveyed. Accordingly, the media conveying apparatus 100 can secure the space between the media table 103 and the ejection table 105. The user can place a medium to be conveyed next on the media table 103 without being hindered by the ejection table 105. Thus, the media conveying apparatus 100 can enhance the convenience of the user.

The operation in step S308, the operation in step S310, the operation in step S312, and/or the operations in steps S313 to S314 may be omitted.

As described above in detail, the media conveying apparatus 100 widens the space between the media table 103 and the ejection table 105 by raising the ejection table 105 arranged above the media table 103 based on a determination that all the media on the media table 103 have been conveyed. Accordingly, the user can favorably place a medium to be conveyed next on the media table 103 without being hindered by the ejection table 105. As a result, the media conveying apparatus 100 allows the user to easily place the medium on the media table 103 above which the ejection table 105 is disposed.

When the ejection table 105 is arranged at a relatively low position above the media table 103, the space between the ejection table 105 and the media table 103 is reduced. As a result, the user has some difficulties in setting a medium on the media table 103. By contrast, when the ejection table 105 is arranged at a relatively high position, the space between the ejection port and the ejection table 105 is reduced. As a result, a sufficient amount of media cannot be stacked on the ejection table 105. If both the space between the ejection table 105 and the media table 103 and the space between the ejection port and the ejection table 105 are increased, the apparatus size is increased. The media conveying apparatus 100 raises the ejection table 105 (as an initial state) before starting the media reading process and lowers the ejection table 105 along with the conveyance of media. Accordingly, the media conveying apparatus 100 allows the user to easily place the medium on the media table 103 and can stack a sufficient amount of media on the ejection table 105 while preventing an increase in the apparatus size.

Figure 12:
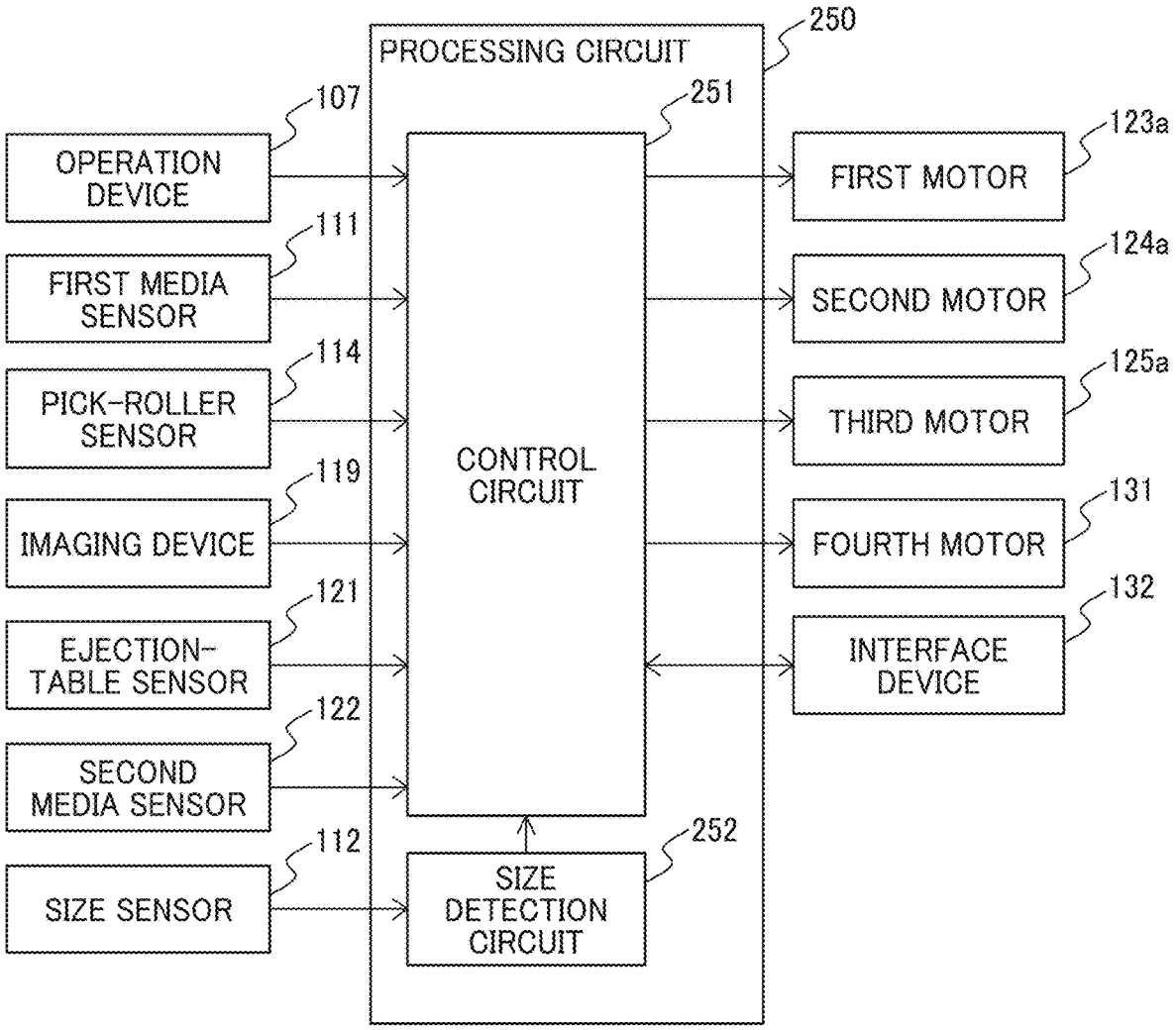
FIG. 12 is a schematic diagram illustrating a configuration of a processing circuit according to another embodiment.

FIG. 12 is a schematic diagram illustrating a configuration of a processing circuit 250 of a media conveying apparatus according to another embodiment of the present disclosure.

The processing circuit 250 substitutes for the processing circuit 150 of the media conveying apparatus 100, and executes, for example, the media reading process instead of the processing circuit 150. The processing circuit 250 includes, for example, a control circuit 251 and a size detection circuit 252. These circuits may be, for example, independent integrated circuits, microprocessors, or firmware.

The control circuit 251 is an example of a control unit and functions like the control unit 151. The control circuit 251 receives the operation signal from the operation device 107 or the interface device 132. The control circuit 251 also receives the first media signal, the pick-roller signal, the ejection-table signal, and the second media signal from the first media sensor 111, the pick-roller sensor 114, the ejection-table sensor 121, and the second media sensor 122, respectively. The control circuit 251 receives a detection result indicating the size of the medium placed on the media table 103 from the size detection circuit 252. The control circuit 251 controls the first motor 123*a*, the second motor 124*a*, the third motor 125*a*, and the fourth motor 131 based on the received information, acquires an input image from the imaging device 119, and outputs the input image to the interface device 132.

The size detection circuit 252 is an example of a size detection unit and functions like the size detection unit 152. The size detection circuit 252 receives a size signal from the size sensor 112, detects the size of the medium on the media table 103, and outputs the detection result to the control circuit 251.

As described above in detail, the media conveying apparatus including the processing circuit 250 allows the user to easily place a medium on the media table 103 above which the ejection table 105 is disposed.

Although several embodiments of the present disclosure have been described above, the embodiments are not limited thereto. For example, the extension tray may be drawable (slidable) from the ejection table, instead of being rotatable with respect to the ejection table. In this case, the extension-tray moving assembly may slide the extension tray to draw or accommodate the extension tray from or in the ejection table, with a member such as a motor, a pinion, a rack, a solenoid, a belt, and/or a cam.

The size sensor may include an image sensor that includes, as imaging elements, CMOSs or CCDs arranged two-dimensionally, instead of the light emitter and the light receiver. In this case, the size sensor further includes a lens that forms an image on the imaging elements and an A/D converter that amplifies the electric signals output from the imaging elements and performs A/D conversion. The size sensor generates an image by imaging a medium placed on the media table or imaging the media table and the pullout tray, and outputs a size signal including the generated image. In step S204, the size detection unit uses a known image processing technique to determine whether the image included in the size signal includes the pullout tray 104 or a medium of a predetermined size or larger. When the image includes the pullout tray 104 or a medium of the predetermined size or larger, the size detection unit determines that the size of the medium on the media table 103 is the predetermined size or larger. By contrast, when the image does not include the pullout tray 104 or the medium of the predetermined size or larger, the size detection unit determines that the size of the medium on the media table 103 is not the predetermined size or larger.

According to one or more aspects of the present disclosure, a media conveying apparatus, a media conveying method, and a control program can appropriately change the position of an ejection table (tray) onto which media are ejected.

As a result, the user can easily place media on a media table below the ejection table of the media conveying apparatus.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

The functionality of the elements disclosed herein may be implemented using circuitry or processing circuitry which includes general purpose processors, special purpose processors, integrated circuits, ASICs ("Application Specific Integrated Circuits"), FPGAs ("Field-Programmable Gate Arrays"), and/or combinations thereof which are configured or programmed, using one or more programs stored in one or more memories, to perform the disclosed functionality. Processors are considered processing circuitry or circuitry as they include transistors and other circuitry therein. In the disclosure, the circuitry, units, or means are hardware that carry out or are programmed to perform the recited functionality. The hardware may be any hardware disclosed herein which is programmed or configured to carry out the recited functionality.

There is a memory that stores a computer program which includes computer instructions. These computer instructions provide the logic and routines that enable the hardware (e.g., processing circuitry or circuitry) to perform the method disclosed herein. This computer program can be implemented in known formats as a computer-readable storage medium, a computer program product, a memory device, a record medium such as a CD-ROM or DVD, and/or the memory of a FPGA or ASIC.

The invention claimed is:

1. A media conveying apparatus comprising:

a media table on which media are to be placed;

a conveyance roller to convey the media placed on the media table;

an ejection roller to eject the media conveyed by the conveyance roller;

an ejection table movable and disposed above the media table to stack the media ejected by the ejection roller; and circuitry configured to control the ejection table, wherein the media table overlaps the ejection table when viewed in a vertical direction, and wherein the circuitry controls the ejection table to be lowered while the media on the media table are sequentially conveyed, and controls the ejection table to be raised to widen a space between the media table and the ejection table when conveyance has ended.

2. The media conveying apparatus according to claim 1, wherein the circuitry is further configured to control the ejection table to be raised in response to power-on of the media conveying apparatus.

3. The media conveying apparatus according to claim 1, further comprising a sensor to detect the media on the media table, wherein the circuitry is configured to determine completion of conveyance of all the media on the media table based on an output signal from the sensor.

4. The media conveying apparatus according to claim 1, further comprising a sensor to detect the media on the ejection table, wherein the circuitry controls the ejection table to be raised until a table face of the ejection table or an uppermost medium of the media on the ejection table reaches a predetermined height, based on an output signal from the sensor.

5. The media conveying apparatus according to claim 1, wherein:

the circuitry is further configured to determine a size of the media on the media table; and the ejection table is extendable, wherein the circuitry controls the ejection table to be extended based on the determined size of the media.

6. The media conveying apparatus according to claim 1, wherein:

the ejection table includes a rotatable extended portion at a downstream end portion of the ejection table in a direction in which the media are ejected; and the circuitry controls the extended portion to be rotated in response to completion of conveyance of all the media on the media table.

7. A media conveying method, comprising:

conveying media placed on a media table by a conveyance roller;

ejecting the media conveyed by the conveyance roller onto an ejection table by an ejection roller;

lowering the ejection table while the media on the media table are sequentially conveyed; and raising the ejection table to widen a space between the media table and the ejection table when conveyance has ended, wherein the media table overlaps the ejection table when viewed in a vertical direction.

8. A non-transitory recording medium storing a plurality of instructions which, when executed by one or more processors, causes the one or more processors to perform a method including:

lowering an ejection table while media on a media table are sequentially conveyed; and raising the ejection table to widen a space between the media table and the ejection table when conveyance has ended, wherein the media table overlaps the ejection table when viewed in a vertical direction.

* * * * *